US005165870A

United States Patent [19]

Sato

[11] Patent Number: 5,165,870

[45] Date of Patent: Nov. 24, 1992

[54] REFRIGERANT COMPRESSOR

[75] Inventor: Sinobu Sato, Kanagawa, Japan

[73] Assignee: Kabushiki Kaisha Toshiba, Kawasaki, Japan

[21] Appl. No.: 707,765

[22] Filed: May 30, 1991

[30] Foreign Application Priority Data

May 30, 1990 [JP] Japan ..... 2-142994

[51] Int. Cl.[5] ..... F04B 35/04; F04C 29/00

[52] U.S. Cl. ..... 417/410; 418/178; 418/179

[58] Field of Search ..... 418/178, 179; 417/410

[56] References Cited

U.S. PATENT DOCUMENTS

| | | | |
|---|---|---|---|
| 3,712,767 | 1/1973 | Beutter | 418/178 X |
| 3,747,944 | 7/1973 | Roy et al. | 60/39.511 X |
| 4,225,294 | 9/1980 | Kakuwa et al. | 418/178 X |
| 4,944,663 | 7/1990 | Iizuka et al. | 418/178 |
| 5,087,181 | 2/1992 | Kamitsuma et al. | 418/178 |

FOREIGN PATENT DOCUMENTS

| | | | |
|---|---|---|---|
| 2825434 | 12/1978 | Fed. Rep. of Germany . | |
| 7245513 | 8/1973 | France . | |
| 60-150462 | 8/1985 | Japan . | |
| 32293 | 2/1987 | Japan | 418/179 |

OTHER PUBLICATIONS

Wear, 108 (1986) pp. 375-384, Kang et al: The "Breaking-In" of Lubricated Surfaces.

*Primary Examiner*—Leonard E. Smith

*Attorney, Agent, or Firm*—Oblon, Spivak, McClelland, Maier & Neustadt

[57] ABSTRACT

A rotational speed variable type refrigerant compressor includes a closed vessel in which a refrigerator oil is received and stored, a rotational speed variable type motor mechanism and a compressing mechanism driven by the motor mechanism to compress a refrigerant. The compressing mechanism includes a slidable part which comprises a first slidable member made of a ferrous material with a nitrided layer composed of an iron nitride as a main component formed on the surface thereof and a second slidable member made of a ferrous material with an iron oxide layer composed of $Fe_3O_4$ as a main component formed on the surface thereof along which the first slidable member comes in slidable contact with the second slidable member. For example, a shaft is constituted by the first slidable member. In addition, for example, each of the bearings for rotatably supporting the shaft is consituted by the second slidable member. Since the slidable part is constituted by combinative employment of the first slidable member and the second slidable member, an occurrence of abnormal wear between the first slidable member and the second slidable member can be prevented even when a film of lubricant therebetween is undesirably broken.

17 Claims, 6 Drawing Sheets

REFRIGERANT COMPRESSOR

BACKGROUND OF THE INVENTION

1. FIELD OF THE INVENTION

The present invention relates generally to a compressor for compressing a refrigerant.

More particularly, the present invention relates to a slidable part preferably employable for a rotational speed variable type refrigerant compressor.

Further, the present invention relates to a rotational speed variable type refrigerant compressor having the foregoing slidable part used therefor.

2. DESCRIPTION OF THE RELATED ART

To improve a property of wear resistance of machine parts or components, various kinds of nitriding treatments have been heretofore carried out for the machine parts or components. In addition, it has been found that reliability of an apparatus or device can be improved and its running life can be elongated by utilizing the technology of nitriding treatment.

This technology of nitriding treatment will briefly be described below with reference to a refrigerant compressor as one example. For example, a rotary type refrigerant compressor is constructed such that a motor mechanism and a compressing mechanism are arranged in a closed casing. The motor mechanism is operatively connected to the compressing mechanism via a shaft extending therebetween. The compressing mechanism is driven by the motor mechanism via the shaft.

The shaft extends through a cylinder of the compressing mechanism, and the upper and lower ends of the shaft are rotatably supported by bearings. Specifically, the shaft is rotatably supported by a bearing in the housing and a sub-bearing at the lower end thereof. A part of the shaft in a cylinder is machined in the form of a crank, and a roller is rotatably fitted onto the crank. In addition, a blade extends through the cylinder to divide the interior of the cylinder into a suction chamber and a discharge chamber. One end of the blade comes in slidable contact with the outer surface of the roller by the biasing force of a spring. As the shaft is rotated, the roller repeatedly performs planetary movement, causing a refrigerant to be compressed. The compressed refrigerant is once discharged into the casing and it is then supplied to the refrigerator side via a discharge tube extending from the casing.

As mentioned above, the shaft is rotated while coming in slidable contact with the bearing surfaces of the frame and the subbearing. To smoothly carry out slidable movement of the slidable part, a refrigerator oil is received and stored in the casing. The refrigerator oil is sucked up by a pump disposed at the lower end of the shaft so as to allow respective slidable parts to be lubricated with the refrigerator oil.

As will be apparent from the above description, wear of the shaft and associated components becomes a significant problem. Specifically, a thrust portion on the lower surface of the crank of the shaft is rotatably brought in slidable contact with the subbearing while receiving the dead weight of the shaft in the motor mechanism as well as the dead weight of the rotor in the compressing mechanism. When a film of lubricant on the slidable surface is broken, the slidable contact surface between the upper surface of the subbearing and the lower surface of the crank of the shaft is worn as the shaft is rotated. In addition, since the shaft receives the biasing force of the spring via the roller and moreover receives a pressure in the cylinder, the shaft is thrusted against the frame and the subbearing, whereby the shaft is forcibly rotated in the slightly bent or curved state. For this reason, when the lubricant film is broken, the outer surface of the shaft and the inner surfaces of the frame and the subbearing are worn undesirably. To prevent an occurrence of wearing as mentioned above, endeavors have been made to improve a property of wear resistance, e.g., by allowing the surface of the shaft to be subjected to various kinds of nitriding treatments to form an iron nitride layer on the surface of the shaft.

However, with respect to a refrigerant compressor including a rotational speed variable type motor, there arises a problem that a sufficiently high effect for preventing wear can not be obtained merely by carrying out nitriding treatment, because the shaft is rotated within the wide operational range from a very low rotational speed to a very high rotational speed. Especially, when the shaft is rotated at a low rotational speed lower than 30 Hz, the lubricant film between the shaft and the bearing is easily broken. Once the lubricant film is broken, an opponent member is largely worn, though wear on the shaft side is suppressed considerably. On the contrary, when the shaft is rotated at a high rotational speed in excess of 120 Hz, a malfunction of hot seizure readily takes place even with the shaft which has been subjected to nitriding treatment, because a large magnitude of load is imparted to the shaft. FIG. 7 is a diagram which illustrates that a quantity of wear varies depending on the rotational speed of the shaft.

In view of the foregoing problem, to elevate reliability of the rotational speed variable type refrigerant compressor, many requests have been raised from users so as to improve a property of wear resistance of the slidable members during operation of the refrigerant compressor not only at a very low rotational sped but also at a very high rotational speed, because the lubricant film is easily broken at these rotational speeds.

SUMMARY OF THE INVENTION

The present invention has been made with the foregoing background in mind.

An object of the present invention is to provide a slidable part employable for a rotational speed variable type refrigerant compressor wherein an excellent property of wear resistance is exhibited under the severe operational condition that a film of lubricant is broken.

Another object of the present invention is to provide a rotational speed variable type refrigerant compressor which makes it possible to improve a property of wear resistance of a slidable part during operation of the refrigerant compressor not only at a very low rotational speed but also at a very high rotational speed at which a film of lubricant is easily broken and moreover stably operate the refrigerant compressor for a long period of time.

To accomplish the former object, the present invention provide a slidable part employable for a rotational speed variable type refrigerant compressor, wherein the slidable part comprises a first slidable member made of a ferrous material, the first slidable member having a nitrided layer composed of an iron nitride as a main component formed on the surface thereof; and a second slidable member made of a ferrous material, the second slidable member having an iron oxide layer composed of $Fe_3O_4$ as a main component formed on the surface thereof along which the iron oxide layer comes in slidable contact with the nitrided layer.

Further, to accomplish the latter object, the present invention provides a rotational speed variable type refrigerant compressor, wherein the refrigerant compressor comprises a closed vessel in which a refrigerator oil is received and stored; a compressing mechanism including a slidable part which comprises a first slidable member made of a ferrous material with a nitrided layer composed of an iron nitride as a main component formed on the surface thereof and a second slidable member made of a ferrous material with an iron oxide layer composed of $Fe_3O_4$ as a main component formed on the surface thereof along which the iron oxide layer comes in slidable contact with the nitrided layer, the compressing mechanism being accommodated in the closed casing; and a rotational speed variable type motor mechanism for driving the compressing mechanism, the motor mechanism being accommodated in the closed casing.

Since the slidable part in the compressing mechanism is constructed by combinative employment of the first slidable member and the second slidable member, an occurrence of abnormal wear in the slidable part can reliably be prevented even when a film of lubricant is broken. Consequently, the present invention makes it possible to provide a refrigerant compressor having high reliability and an elongated running life.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
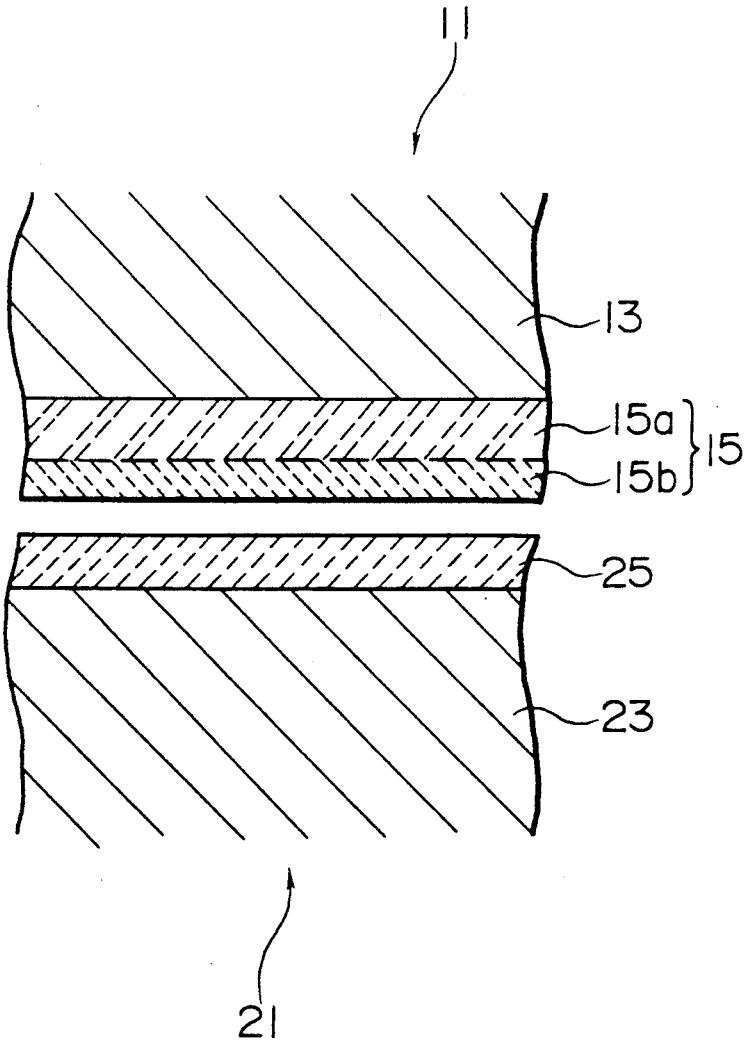
FIG. 1 is a fragmentary sectional view which schematically illustrates arrangement of two slidable members fabricated in accordance with an embodiment of the present invention.

FIG. 1 is a fragmentary sectional view which schematically illustrates arrangement of slidable members employable for a rotational speed variable type refrigerant compressor in accordance with the embodiment of the present invention. One of the slidable members, i.e., a first slidable member 11 is constructed such that a nitrided layer 15 is formed on the surface of a ferrous material 13 serving as a substrate. Various kinds of ferrous materials usually used for the slidable members in the compressor may be employed for the first slidable member 11, provided that it is proven that they can be used as a slidable member for the refrigerant compressor. For example, a carbon steel, an alloy steel, a cast iron, a stainless steel and so forth are employable as a ferrous material for the first slidable member 11, respectively.

The nitrided layer 15 formed on the surface of the ferrous material 13 is composed of one of nitrided irons FeN to $Fe_4N$ as a main component. The nitrided layer 15 is normally dimensioned to have a thickness within the range of 1 to 100 microns. It is preferable that the nitride layer 15 has a thickness within the range of 2 to 20 microns. Especially, when the nitrided layer 15 has a thickness within the range of 2 to 20 microns, it exhibits ductility to some extent. With this thickness of the nitrided layer 15, a weak point of brittleness inherent to the nitrided iron is compensated by the ductility.

A gas nitriding method, a salt bath nitriding method, a carburizing/nitriding method, an ion nitriding method and so forth are employable as a method of forming the nitrided layer 15, respectively. Among the aforementioned nitriding methods, the ion nitriding method is most preferably employable. The ion nitriding method makes it possible to uniformly nitride a ferrous material under the operational condition of a lower temperature. In addition, the iron nitriding method makes it possible to nitride a ferrous material in a single layer. Since the ion nitriding method can be practiced at a lower temperature, parts for the refrigerant compressor each machined with a high dimensional accuracy can be treated without any thermal deformation. For this reason, it can be mentioned that the ion nitriding method is suitably employable for the refrigerant compressor of the present invention.

As shown in FIG. 1, the nitrided layer 15 is constituted by a diffusion layer **15*a* and a compound layer 15*b*. The diffusion layer 15*a* contributes to stable integration of the compound layer 15*b* with the substrate of the ferrous material 13. The diffusion layer 15*a* is composed of an iron nitride $Fe_4N$ as a main component. On the other hand, the compound layer 15*b*** is composed of one of iron nitrides FeN to $Fe_3N$ as a main components. In practice, the compound layer contributes directly to improvement of wear resistance of the slidable member.

The refrigerant compressor includes a second slidable member 21 which serves as an opponent member during slidable movement of the first slidable member 11. The second slidable member 21 is constructed such that an iron oxide layer 25 containing $Fe_3O_4$ as a main component is formed on the surface of a ferrous material 23 serving as a substrate. The iron oxide layer 25 is formed at least on the surface thereof along which the nitrided layer 15 of the first slidable member 11 comes in slidable contact with the iron oxide layer 25 of the second slidable member 21. According to the embodiment of the present invention, a slidable part in the refrigerant compressor is constructed by combining the first slidable member 11 with the second slidable member 21 such that the nitrided layer 15 comes in slidable contact with the iron oxide layer 25.

Since the iron oxide layer 25 is composed of $Fe_3O_4$ as a main component, it has a high hardness. In addition, the iron oxide layer 25 exhibits a porous state. For this reason, a lubricant can be reserved in the porous iron oxide layer 25. As long as the iron oxide layer 25 itself retains a lubricant in the interior thereof, an excellent slidable contact state can be maintained even when breakage of a film of lubricant takes place between the first slidable member 11 and the second slidable member 21. In other words, an occurrence of abnormal wear on the opponent member relative to the nitrided layer (the second slidable member 21 in the shown embodiment) can be prevented reliably.

It is acceptable that the iron oxide layer 25 formed on the second slidable member 21 has a thickness within the range of 5 to 100 microns. When a thickness of the iron oxide layer 25 composed of $Fe_3O_4$ as a main component exceeds 100 microns, the iron oxide layer 25 is easily broken due to its brittleness. On the contrary, when a thickness of the iron oxide layer 25 is less than 5 microns, the iron oxide layer 25 fails to have a sufficiently high hardness.

A method of oxidizing the surface of a substrate (under an atmosphere of steam having a high temperature) (hereinafter referred to as surface oxidation treatment) is preferably employable as a method of forming the iron oxide layer 25 composed of $Fe_3O_4$ as a main component, because the surface oxidation treatment makes it possible to uniformly treat a number of parts or components. When the surface oxidation treatment is carried out, not only an ordinary iron oxide layer composed of $Fe_2O_3$ as a main component but also an iron oxide composed of $Fe_3O_4$ as a main component can be formed on the surface of a substrate. In a case where an opponent slidable member is composed of a nitrided substrate, the oxide of $Fe_3O_4$ exhibits an excellent effect in respect of a property of wear resistance.

Figure 2:
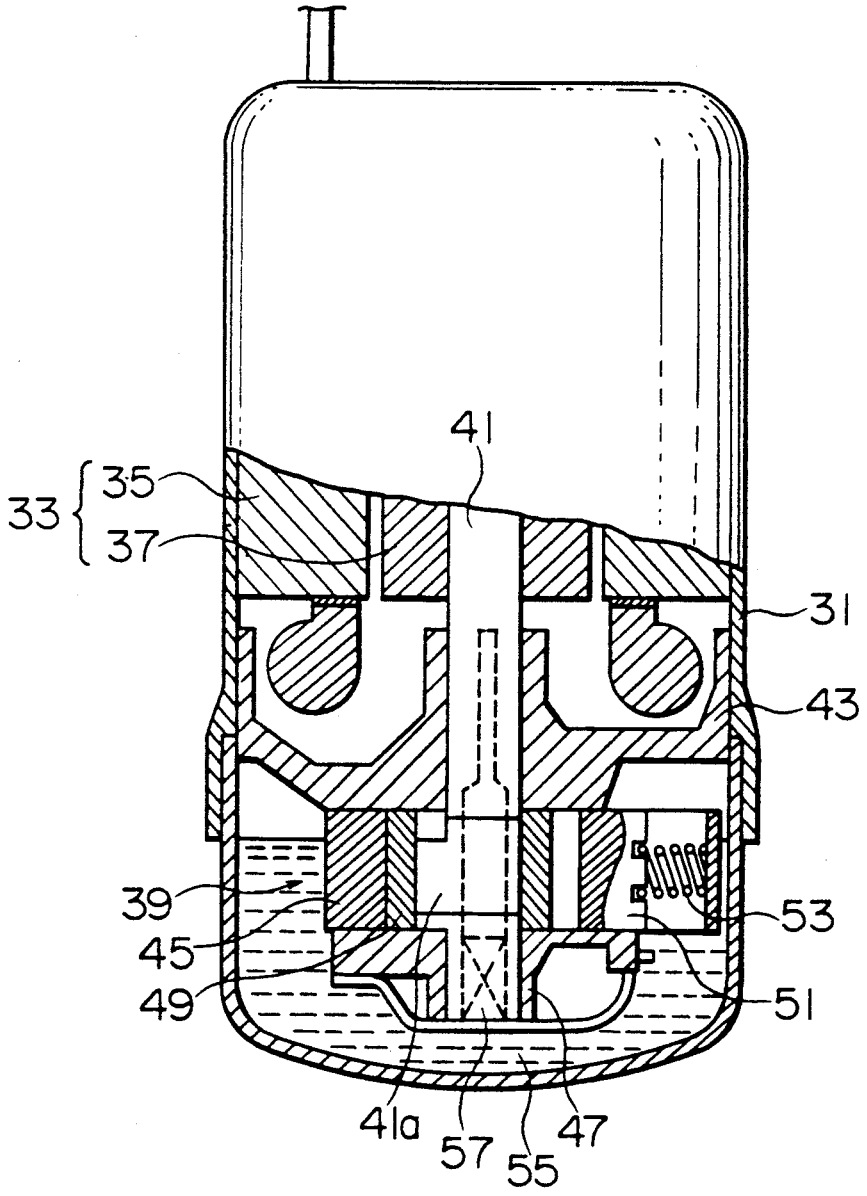
FIG. 2 is a partially exploded vertical sectional view which illustrates the structure of a rotational speed variable type refrigerant compressor in accordance with another embodiment of the present invention.

The aforementioned slidable members are preferably employable for, e.g., a refrigerant compressor as shown in FIG. 2. FIG. 2 is a fragmentary vertical sectional view of a closed type refrigerant rotary compressor in accordance with another embodiment of the present invention.

For example, a rotational speed driving type motor 33 is accommodated in a closed casing 31. The motor 33 is constituted by a stator 35 and a rotor 37. A compressing mechanism 39 is arranged at the lower part of the motor 33. The compressing mechanism 39 is operatively connected to the motor 33 via a shaft 41. The shaft 41 to be rotated by the motor 33 is rotatably supported by a bearing in a frame 43 and extends through a cylinder 45. Additionally, the lower end of the shaft 41 is rotatably supported by a subbearing 47.

A part of the shaft 41 located within the cylinder 45 is constructed in the form of a crank portion **41*a* (eccentric portion). A roller 49 is fitted into the space defined between the crank portion 41*a* and the cylinder 45. As the shaft 41 is rotated, the roller 49 repeatedly carries out planetary movement. In addition, a blade 51 is disposed in the cylinder 45 while extending through the cylinder 45. The left-hand end of the blade 51 comes in slidable contact with the outer surface of the roller 48 by the biasing force given by a spring 53. As the roller 49 repeatedly carries out planetary movement, the blade 51 moves reciprocably. In addition, the blade 51 divides the interior of the cylinder 45 into a suction chamber and a discharge chamber. As the roller 49 carries out planetary movement as the shaft 41** is rotated, a gas serving as a refrigerant is introduced into the suction chamber via an inlet port so that it is compressed and discharged to the refrigerator side via an outlet port.

A refrigerator oil 55 is received and stored in the lower part of the casing 31. As the shaft 31 is rotated, the refrigerator oil 55 is sucked up by a pump 57 mounted on the lower end of the shaft 31 so as to lubricate respective slidable portions with the refrigerator oil 55.

The slidable portions in the cooling medium compressor in accordance with the embodiment of the present invention are noted below.

The shaft 41 receives via the roller 49 the biasing force of the spring 53 and the force derived from a pressure in the cylinder 45. These forces squeeze the shaft 41 against the frame 43 and the subbearing 47, whereby the shaft 43 is rotated at a high rotational speed while exhibiting a slightly bent or curved shape. A thrust part on the lower surface of the crank portion **41*a* mounted on the shaft 41 comes in slidable contact with the subbearing 47 while receiving the dead weight of the rotor 37 as well as the dead weight of the shaft 41 of the motor 33. Thus, the contact region where the outer surface of the shaft 41 contacts the inner surface of the subbearing 47 becomes a slidable portion. In addition, the contact region where the lower surface of the crank portion 41*a* contacts the upper surface of the subbearing 47** becomes a slidable portion too.

According to the embodiment of the present invention, for example, the refrigerant compressor is constructed such that the shaft 41 is constituted by the first slidable member and each of the frame 43 and the subbearing 47 is constituted by the second slidable member. Specifically, the shaft 41 is constituted by a ferrous material, and a nitrided layer composed of an iron nitride as a main components is formed on the surface of the ferrous material constituting the shaft 41. Additionally, each of the the frame 43 and the subbearing 47 is constituted by a ferrous material, and an iron oxide layer composed of $Fe_3O_4$ as a main component is formed at least on their bearing surfaces.

Since the slidable parts are constructed in the above-described manner, they continuously maintain an excellent property of wear resistance without any occurrence of abnormal wear on the nitrided layer and the iron oxide layer which are located opposite to each other, even when a film of lubricant is temporarily broken on the slidable movement surface extending therebetween. Consequently, a property of resistance of the slidable parts against wearing during operation of the refrigerant compressor not only at a high rotational speed but also at a low rotational speed can be improved by combinative employment of the shaft and the bearing in the refrigerant compressor in the above-described manner. In addition, a running life of each of the slidable parts can be elongated substantially.

Next, the present invention will be described in more details below with respect to an example of the slidable parts, an example of the refrigerant compressor having the slidable parts used therefor and results derived from evaluation on the slidable parts and the refrigerant compressor.

EXAMPLE 1

A first slidable member was employed for a shaft in the refrigerant compressor of the present invention. First, a chrominum-molibdenum steel (JIS SCM 35 specified in accordance with Japanese Industrial Standard (hereinafter referred to simply as SCM 35)) was machined to assume a predetermined configuration corresponding to the shaft. After completion of the machining operation, the shaft was immersed in a bath of acetone for the purpose of deoiling. Then, the shaft was placed in a glow discharge type ion nitriding equipment including a vessel made of a stainless steel in which it was held on a base plate. Subsequently, the equipment was evacuated to reach a vacuum of about 10 Torr by operating an oil diffusion pump and a rotary pump. At this time, the base plate was heated to an elevated temperature of 350° C. Then, a mixture of $N_2$ gas and $H_2$ gas was introduced into the equipment at a flow rate of 1000 SCCM to maintain the inner pressure of the equipment at a level of about 5 Torr. Thereafter, a voltage of 1200 V was applied to electrodes to treat the shaft for 75 minutes under the operational condition that an electric power was consumed at a rate of 0.5 $W/cm^2$ for the whole surface area of a shaft to be treated. On completion of this treatment, a nitrided layer having a thickness of about 10 microns was formed on the surface of the shaft.

On the other hand, a second slidable member was employed for a bearing. First, a cast iron FC 20 was machined to assume a predetermined configuration. Subsequently, the bearing was heated to an elevated temperature within the range of 350° to 450° C. After the temperature of the bearing was stabilized, a steam was blown toward the bearing, whereby an iron oxide layer composed of $Fe_3O_4$ as a main component was formed on the surface of the bearing which was to serve as a bearing surface.

Figure 3:
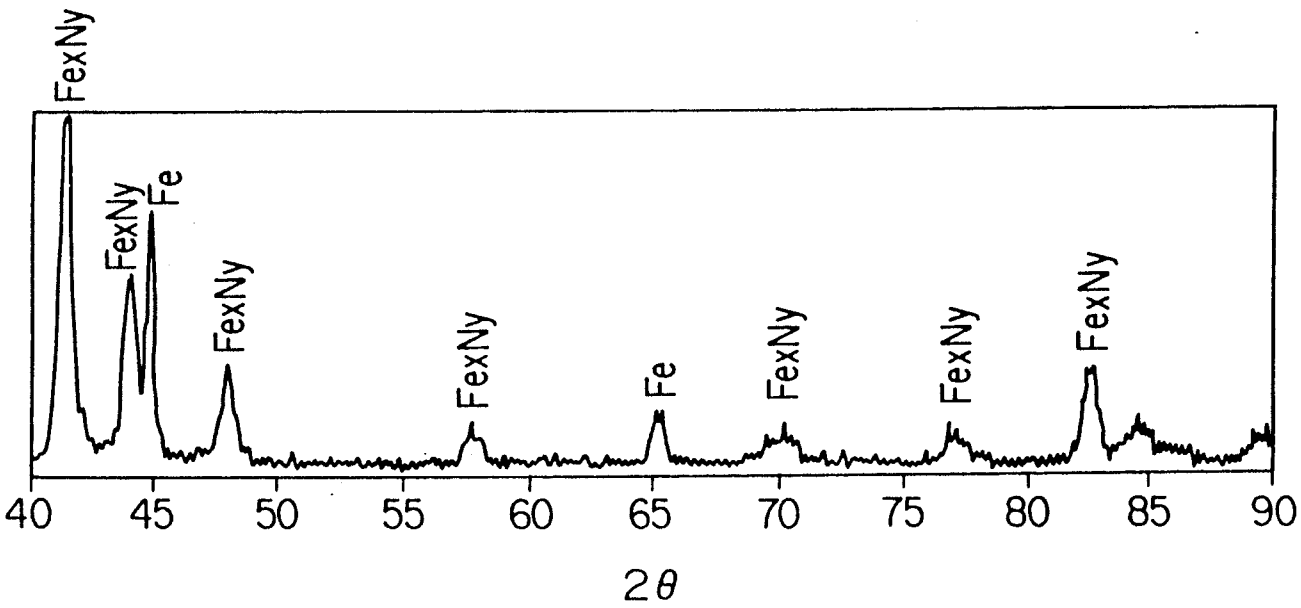
FIG. 3 is a diagram which shows a X-ray diffraction pattern on the surface of a shaft fabricated in accordance with the embodiment of the present invention.
Figure 4:
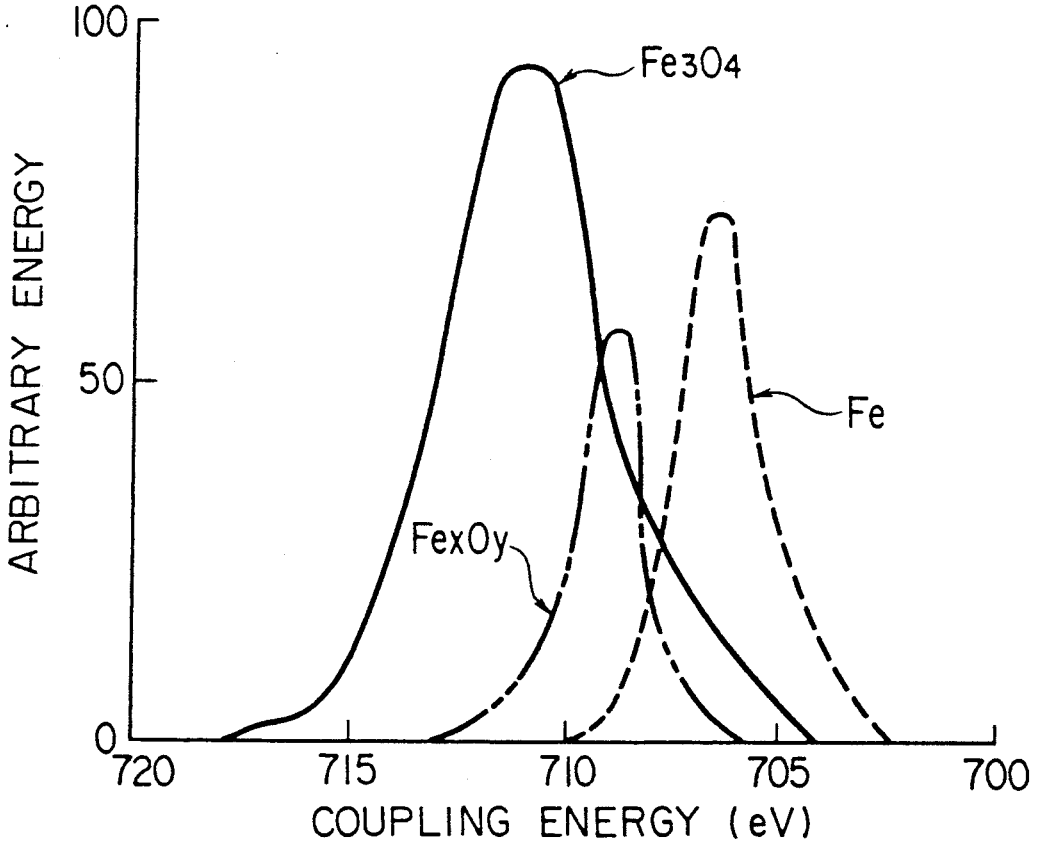
FIG. 4 is a diagram which shows a photoelectronic spectrum representing an oxide layer on the surface of a bearing fabricated in accordance with the embodiment of the present invention.

Cut pieces were obtained from the shaft and the bearing by performing cutting operations. Then, the shaft was analyzed by X-ray diffraction based on its cut piece and the bearing was analyzed based on its cut piece by employing a photoelectronic X-ray spectroscopic analyzing method so as to visually observe the surface structure of each of the shaft and the bearing. FIG. 3 is a diagram which illustrates a X-ray diffraction pattern on the surface of the shaft for the refrigerant compressor of the present invention. As is apparent from FIG. 3, a nitrided iron layer composed of $Fe_2$ or $Fe_3N$ as a main component was formed on the surface of the shaft which has been subjected to ion nitriding treatment. FIG. 4 is a diagram which illustrates a photoelectronic ($Fe_{2p}$) spectrum on the surface of the bearing for the refrigerant compressor of the present invention. As is apparent from FIG. 4, an iron oxide layer composed of $Fe_3O_4$ as a main component was formed on the surface of the bearing which had been subjected to surface oxidation treatment.

Figure 5:
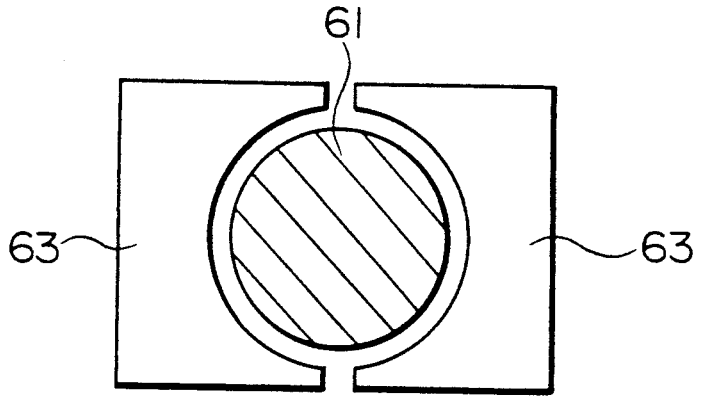
FIG. 5 is a sectional view which schematically illustrates the structure of a wear resistance testing equipment for testing the shaft fabricated in accordance with the embodiment of the present invention in respect of a property of wear resistance.

Subsequently, the shaft and the bearing were tested and evaluated in respect of a property of resistance against hot seizure as well as a dynamic friction coefficient with the aid of a testing equipment as schematically shown in FIG. 5. This equipment is constructed such that a shaft 61 is clamped between an opposing pair of bearings 63 and the shaft 61 is then rotated while the bearings 63 are increasingly tightened to vary a load to be imparted to the shaft 61, so as to examine a load value at which the dynamic friction coefficient varies and hot seizure takes place. In practice, tests for examining a property of resistance against hot seizure were conducted such that the shaft 61 was rotated at a rotational speed of 290 rpm and a load was elevated at a rate of 22.5 kgf/3 min to reach a level of 300 Kgf in order to examine a relationship between the load and the dynamic friction coefficient as well as a load value at which hot seizure took place.

Figure 6:
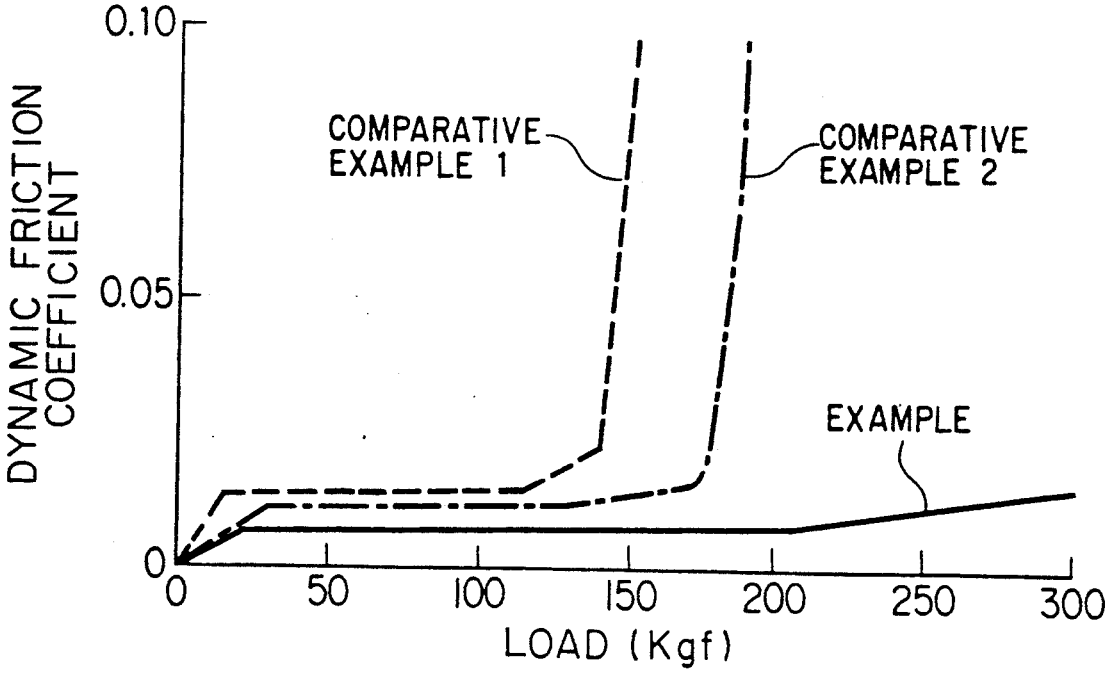
FIG. 6 is a diagram which shows results derived from wear resistance tests.
Figure 7:
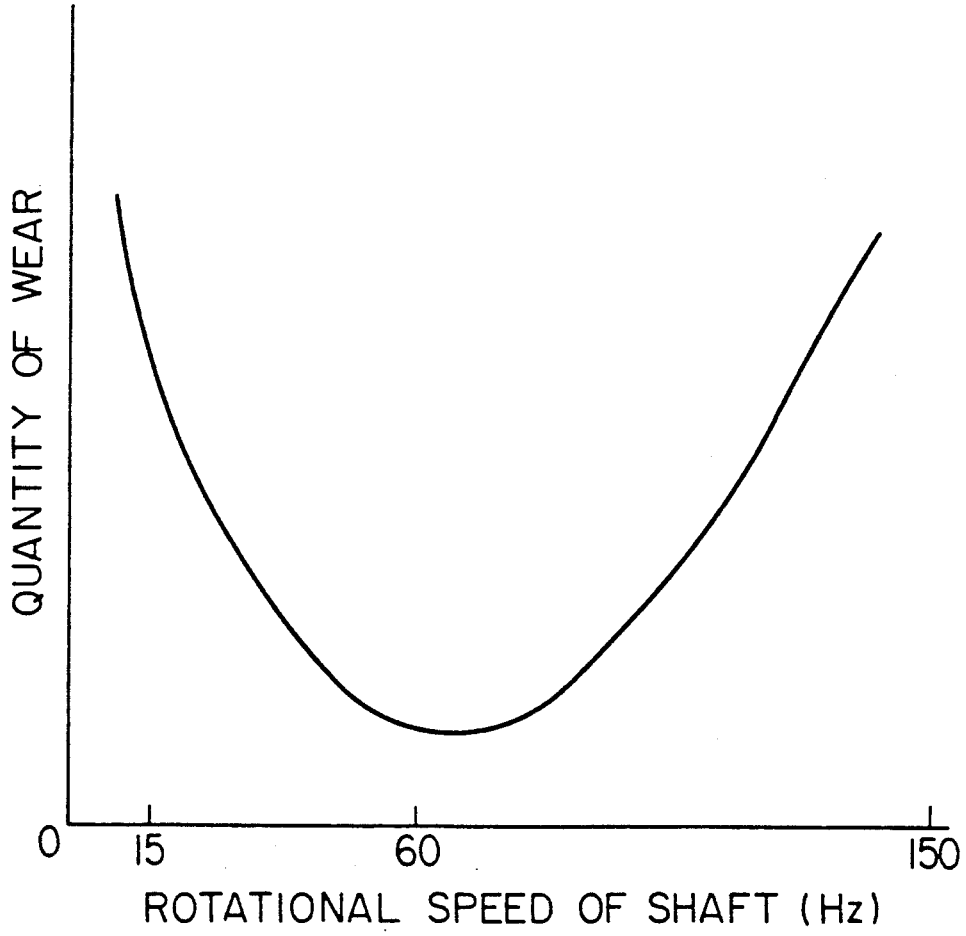
FIG. 7 (PRIOR ART)
FIG. 7 is a diagram which shows a relationship between a rotational speed of a conventional rotational speed variable type refrigerant compressor and a quantity of wear.

The results derived from the tests revealed that the dynamic friction coefficient could be held at a low level when slidable movement was carried out between the shaft having a nitrided layer formed thereon and the shaft having an iron oxide layer composed of $Fe_3O_4$ as a main component formed thereon, even though the load was elevated. In addition, no hot seizure was recognized within the range of a load lower than 3000 Kgf. This fact is apparent from FIG. 6. Further, wear resistance tests were conducted under a constant load by operating the aforementioned testing equipment. The results derived from the tests revealed that the slidable part constructed by combinative employment of the first and second slidable members exhibited a very excellent property of wear resistance.

Next, a refrigerant compressor having the same structure as that of the refrigerant compressor shown in FIG. 2 was assembled using the shaft and the bearing which were fabricated in accordance with the embodiment of the present invention. Then, the refrigerant compressor was practically operated on the trial basis. The results derived from the trial operation of the refrigerant compressor revealed that the refrigerant compressor was well operated within the wide operational range from a low rotational speed of 60 rpm to a high rotational speed of 10000 rpm, without an occurrence of abnormal friction between the shaft and the bearing.

COMPARATIVE EXAMPLE 1

A shaft made of a cast iron FCD 55 was combined with a bearing made of a cast iron FC 20 to construct a slidable part. Tests were conducted under the same operational conditions as those in Example 1 so as to evaluate a property of resistance against hot seizure and a dynamic friction coefficient. The result derived from the evaluation is shown together with the result in Example 1 in FIG. 6. As is apparent from the drawing, hot seizure took place with the shaft in Comparative Example 1 when a load was elevated to a level of 140 kgf.

Additionally, a refrigerant compressor having the same structure as that shown in FIG. 2 was assembled by using the aforementioned slidable part. Then, the refrigerant compressor was practically operated on the trial basis. The results derived from the practical operation of the refrigerant compressor revealed that abnormal wear was caused between the shaft and the bearing during operation of the refrigerant compressor not only at a very low rotational speed but also at a very high rotational speed. Consequently, the refrigerant compressor failed to exhibit sufficiently high reliability.

COMPARATIVE EXAMPLE 2

Tests were conducted under the same operational conditions as those in Example 1 by using a shaft having a nitrided layer formed thereon and a bearing having an iron oxide layer composed of $Fe_2O_3$ as a main component, so as to evaluate a property of resistance against hot seizure as well as a dynamic friction coefficient. The result derived from the evaluation is shown together with that in Example 1 in FIG. 6. As is apparent from the drawing, the shaft in Comparative Example 2 had a high friction coefficient compared with that in Example 1. In addition, hot seizure took place when the load was elevated to a level of 180 kgf. In other words, the slidable member having an iron oxide layer composed of $Fe_2O_3$ as a main component formed thereon had a property of wear resistance lower than that of the slidable member having an iron oxide layer composed of $Fe_3O_4$ as a main component in accordance with the embodiment of the present invention.

In addition, a refrigerant compressor having the same structure as that of the refrigerant compressor shown in FIG. 2 was assembled using the shaft and the bearing. Then, the refrigerant compressor was practically operated on the trial basis. The results derived from the practical operation of the refrigerant compressor revealed that it was recognized that wear between the shaft and the bearing proceeded undesirably not only at a very low operational speed but also at a very high rotational speed. Consequently, the refrigerant compressor failed to exhibit sufficiently high reliability.

As is apparent from the aforementioned results, more excellent wear resistance could be obtained by forming on the surface of an opponent slidable member an iron oxide layer composed of $Fe_3O_4$ as a main component but not an iron oxide layer composed of $Fe_2O_3$ as a main component, in order to effectively utilize the nature of an iron nitride layer formed on the surface of a substrate for the purpose of improving a property of wear resistance. Specifically, in a case where a nitrided layer composed of a nitrided iron as a main component is formed on one of two slidable members made of a ferrous material and located opposite to each other, an excellent property of wear resistance can be realized within the wide range of a rotational speed by employing a ferrous material for an opponent slidable member having an iron oxide layer composed of $Fe_3O_4$ formed on the surface thereof. Additionally, a rotational variable type refrigerant compressor having high reliability and an elongated running life could be obtained according to the present invention.

What is claimed is:

1. A slidable part, comprising;

a first slidable member made of a ferrous material, said first slidable member having a nitrided layer composed of an iron nitride as a main component formed on the surface thereof, and a second slidable member made of a ferrous material, said second slidable member having an iron oxide layer composed of $Fe_3O_4$ as a main component formed on the surface thereof along which said iron oxide layer comes in slidable contact with said nitrided layer.

2. The slidable part as claimed in claim 1, wherein said nitrided layer is composed of an iron nitride including FeN to $Fe_4N$ as a main component.

3. The slidable part as claimed in claim 1, wherein said nitrided layer comprises an iron nitride layer which is formed by carrying out ion nitriding treatment.

4. The slidable part as claimed in claim 1, wherein said nitrided layer has a thickness within the range of 2 to 20 μm.

5. The slidable part as claimed in claim 1, wherein said iron oxide layer exhibits a porous state.

6. The slidable part as claimed in claim 1, wherein said iron oxide layer comprises an iron oxide layer which has been subjected to surface oxidation treatment.

7. The slidable part as claimed in claim 1, wherein said iron oxide layer has a thickness within the range of 5 to 100 μm.

8. A rotational speed variable type refrigerant compressor, comprising;

a closed vessel in which a refrigerator oil is received and stored, a compressing mechanism including a slidable part which comprises a first slidable member made of a ferrous material with a nitrided layer composed of an iron nitride as a main component formed on the surface thereof and a second slidable member made of a ferrous material with an iron oxide layer composed of $Fe_3O_4$ as a main component formed on the surface thereof along which said iron oxide layer comes in slidable contact with said nitrided layer, said compressing mechanism being accommodated in said closed vessel, and a rotational speed variable type motor mechanism for driving said compressing mechanism.

9. The refrigerant compressor as claimed in claim 8, wherein said slidable part comprises a shaft for transmitting a driving force generated by said motor mechanism to said compressing mechanism and bearings for rotatably supporting said shaft.

10. The refrigerant compressor as claimed in claim 9, wherein said shaft is constituted by said first slidable member and each of said bearings is constituted by said second slidable member.

11. The refrigerant compressor as claimed in claim 8, wherein said nitrided layer in said slidable part comprises an iron nitride layer which has been subjected to ion nitriding treatment.

12. The refrigerant compressor as claimed in claim 8, wherein said iron oxide layer in said slidable part exhibits a porous state.

13. The refrigerant compressor as claimed in claim 8, wherein said iron oxide layer in said slidable part is an iron oxide layer which has been subjected to surface oxidation treatment.

14. A rotational speed variable type refrigerant compressor, comprising;

a closed vessel in which a refrigerator oil is received and stored, a rotational speed variable type motor mechanism, a shaft operatively connected to said motor mechanism, said shaft made of a ferrous material with a nitrided layer composed of an iron nitride as a main component formed on the surface thereof, and a compressing mechanism for compressing a refrigerant with a driving force transmitted from said motor mechanism via said shaft, said compressing mechanism including bearings each made of a ferrous material with an iron oxide layer composed of $Fe_3O_4$ as a main component formed on the surface thereof along which said bearings come in slidable contact with said shaft, said compressing mechanism being accommodated in said closed vessel.

15. The refrigerant compressor as claimed in claim 14, wherein said nitrided layer in the slidable part is an iron nitride layer which has been subjected to ion nitriding treatment.

16. The refrigerant compressor as claimed in claim 14, wherein said iron oxide layer in the slidable part exhibits a porous state.

17. The refrigerant compressor as claimed in claim 14, wherein said iron oxide layer is an iron oxide layer which has been subjected to surface oxidation treatment.

* * * * *

UNITED STATES PATENT AND TRADEMARK OFFICE

CERTIFICATE OF CORRECTION

PATENT NO. : 5,165,870

DATED : November 24, 1992

INVENTOR(S) : Sinobu Sato

It is certified that error appears in the above-indentified patent and that said Letters Patent is hereby corrected as shown below:

Column 1, line 24, after "rotary", insert -- - --;
line 50, delete "subbearing", insert --sub-bearing--;
line 60, delete "subbearing", insert --sub-bearing--;
line 65, delete "subbearing", insert --sub-bearing--.

Column 2, line 2, delete "subbearing", insert --sub-bearing--;
line 6, delete "subbearing", insert --sub-bearing--;
line 38, delete "sped", insert --speed--.

Column 5, line 57, delete "subbearing", insert --sub-bearing--.

Column 6, line 21, delete "subbearing", insert --sub-bearing--;
line 26, delete "subbearing", insert --sub-bearing--;
line 30, delete "subbearing", insert --sub-bearing--;
line 33, delete "subbearing", insert --sub-bearing--;
line 43, delete "subbearing", insert --sub-bearing--.

Signed and Sealed this

Eighth Day of February, 1994

Bruce Lehman

*Attest:*

BRUCE LEHMAN

*Attesting Officer*

*Commissioner of Patents and Trademarks*